US006315095B1

(12) United States Patent
Garfinkle

(10) Patent No.: US 6,315,095 B1
(45) Date of Patent: Nov. 13, 2001

(54) SELF-LATCHING SCISSOR MECHANISM

(76) Inventor: Moishe Garfinkle, P.O. Box 15855, Philadelphia, PA (US) 19103

( * ) Notice: Subject to any disclaimer, the term of this patent is extended or adjusted under 35 U.S.C. 154(b) by 0 days.

(21) Appl. No.: 09/366,245

(22) Filed: Aug. 3, 1999

Related U.S. Application Data

(60) Provisional application No. 60/095,409, filed on Aug. 5, 1998.

(51) Int. Cl.[7] ..... A45C 3/02; F16C 11/00

(52) U.S. Cl. ..... 190/100; 190/113; 190/114; 190/900; 190/901; 403/61; 403/117; 403/80; 403/113; 403/52; 403/119; 403/59

(58) Field of Search ..... 403/61, 117, 80, 403/59, 113, 112, 119, 52; 16/366, 370; 190/100, 901, 113, 114

(56) References Cited

U.S. PATENT DOCUMENTS 828,709 * 8/1906 Buckland .
906,568 * 12/1908 Labadie .
2,269,271 * 1/1942 Kiefer .
3,934,770 * 1/1976 Larsen .

* cited by examiner

*Primary Examiner*—Lynne H. Browne
*Assistant Examiner*—Tomlyne A Malcolm

(57) ABSTRACT

It is often necessary to unfold the integral carrying case of a device such as a portable electronic instrument comprising an upper and lower module. However if it is necessary upon unfolding the case to move apart the modules a limited distance while maintaining their relative alignment the common scissor-slider mechanism will not suffice inasmuch as the scissor mechanism does not latch on retraction and rotation. The disclosed invention provides a scissor-slider mechanism that extends without constraint in the usual fashion, but upon retraction and rotation about the slider axis required for folding the scissor-slider mechanism self-latches, keeping the upper and lower modules from separating.

4 Claims, 3 Drawing Sheets

Slide Rod

Upper Module

Scissor Link Assembly
Latch
Lower Module
Carrying Case
1
2
3
5a
4
6

Carrying Case
5
4
1
6

1
7
5a
6
3

1
6
5a
7a
3

1
3
6
5b
7b

Figure 2T
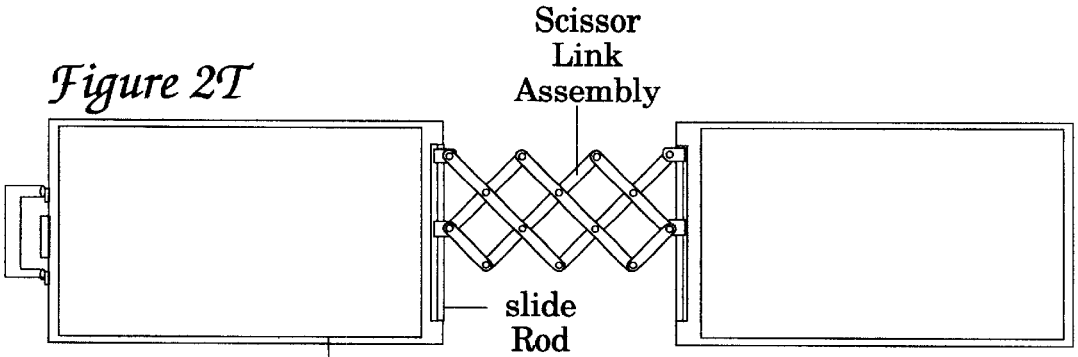
Figure 2S
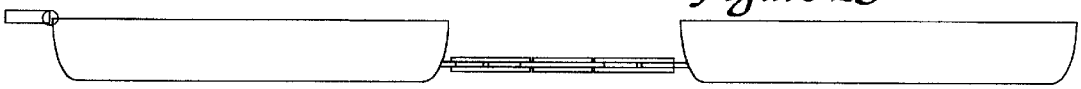
Figure 3T
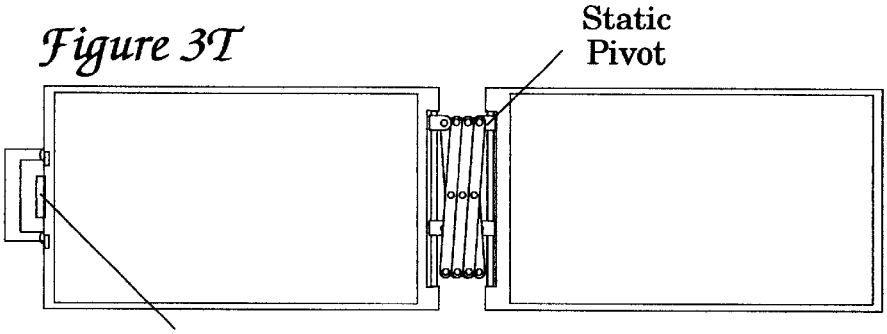
Figure 3S
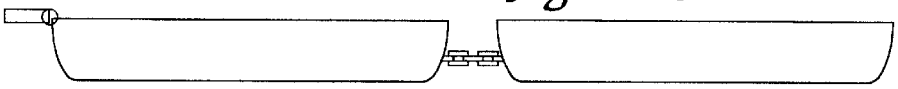
Figure 5S
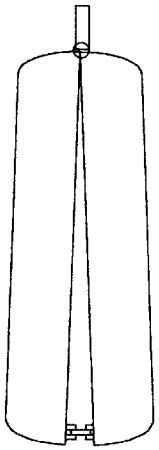
Figure 4S
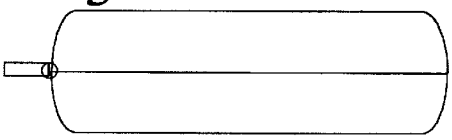
Figure 4E
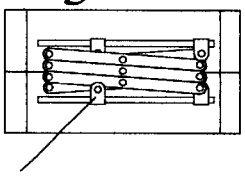
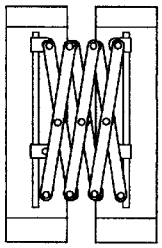
Figure 5E Static Pivot
Slide Pivot
Latch Stop
Slide Rod
Relief
Support Structure
Support Structure
Pivot Bracket Latch Stop
Latch Stop
Slide Pivot Slide Rod
Interference
Support Structure
Slide Pivot
Latch Stop
Slide Pivot

SELF-LATCHING SCISSOR MECHANISM

REFERENCE

Provisional Patent Application 60/095,409 filed Aug. 5, 1998.

BACKGROUND OF THE INVENTION

Generally a carrying case for a device such as a portable electronic instrument comprises an upper and lower module which are hinged together. For example a briefcase type field testing device might contain electronic circuitry in both the upper and lower module, and upon unfolding the control panels of both modules are exposed. Because the device is unfolded and subsequently folded along an axis, simple hinges will suffice with a latching mechanism secured to the edge opposite to the hinged edge. However if it is necessary upon unfolding the case to move apart the modules a limited distance while maintaining their relative alignment as shown in FIGS. 1A and 1B the common scissor link assembly will not suffice.

Although the scissor link assembly can maintain alignment while extended (FIGS. 2T and 2S) and permits retraction (FIGS. 3T and 3S), upon folding and latching the scissor link assembly is still free to extend (FIGS. 4S and 4E). Unless a latch is also placed at the edge of the case upon which the scissor is secured the case can open (FIGS. 5S and 5E), separating the modules and placing a high stress on the latch at the opposite edge of the case. Even if such a secondary latch is provided, the operator, by inadvertently failing to secure the auxiliary latch, can still expose the device to damage. Such an eventuality is obviously undesirable, particular for valuable instruments.

OBJECTIVE OF THE INVENTION

The objective of the present invention is to provide a scissor link assembly that extends without constraint in the usual fashion, but upon retraction and rotation about the slider axis required for folding the scissor-slider mechanism self-latches without manual actuation, preventing separation of the modules. FIGS. 6A and 6B, 7A and 7B, and 8A and 8B illustrate the operation of the latching scissor mechanism. FIG. 6A shows the static and slider pivot to which the conventional scissor linkages are secured to their pivot brackets in the ordinary manner. The pivots are positioned on the slide rod as they would be with the scissor link assembly extended as shown in FIGS. 2T and 2S.

When the scissor link assembly is retracted the slide pivot moves away from the static pivot along the slide rod. To prevent the latch stop from interfering with the motion of the slide pivot the slide pivot is provided with a relief as shown in FIG. 6B.

FIG. 7A shows the slide pivot fully displaced along the slide rod with the scissor link assembly fully retracted as shown in FIGS. 3T and 3S. There is no interference between the slide pivot and the latch stop as shown in FIG. 7B.

Upon the case being folded the static and slide pivots rotate about their slide rod as shown in FIG. 8A, with the scissor link assembly now adjacent the case as shown in FIGS. 4S and 4E. However the latch stop now interferes with the slide pivot as shown in FIG. 8B, preventing the slide pivot from moving back towards the static pivot along the slide rod as required to extend the scissor link assembly, as shown in FIGS. 5S and 4E. Hence the scissor link assembly is locked and the case consequently latched. Of course alternative relief configurations can be provided for the slide pivot as shown in FIG. 5C without affecting the operation of the latching scissor link assembly.

BRIEF DESCRIPTION OF THE DRAWINGS

FIG. 2T: Carrying-case scissor link assembly deployed, top view.

FIG. 2S: Carrying-case scissor link assembly deployed, side view.

FIG. 3T: Carrying-case scissor link assembly retracted, top view.

FIG. 3S: Carrying-case scissor link assembly retracted, side view.

FIG. 4S: Carrying-case modules folded, side view.

FIG. 5E: Carrying-case modules folded, scissor partially deployed, end view.

FIG. 5S: Carrying-case modules folded, scissor partially deployed, side view.

FIG. 4E: Carrying-case modules folded, end view.

PREFERRED EMBODIMENT OF THE INVENTION

Figures 1A, 1B, 9A, 9B, 9C, 9D, 9E:
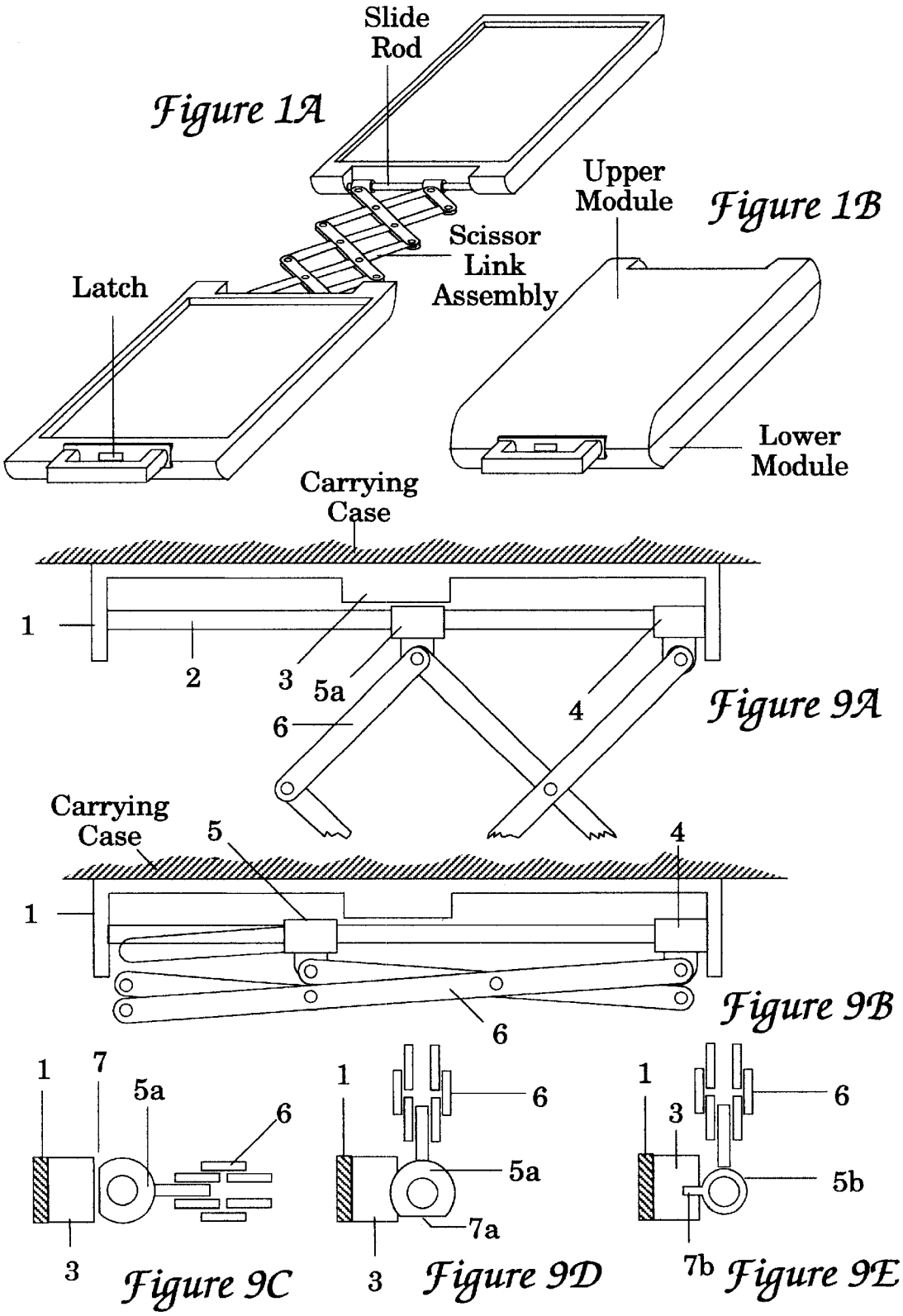
FIG. 1A: Carrying-case modules deployed.
FIG. 1B: Carrying-case modules folded.
FIG. 9A: Carrying-case scissor link assembly deployed, detail.
FIG. 9B: Carrying-case scissor link assembly retracted, detail.
FIG. 9C: Slide pivot orientation, scissor link assembly retracted, detail.
FIG. 9D: Slide pivot orientation, scissor link assembly folded, detail.
FIG. 9E: Alternative Slide Pivot Configuration, scissor link assembly folded, detail.
Figures 6A, 6B, 7A, 7B, 8A, 8B, 8C:
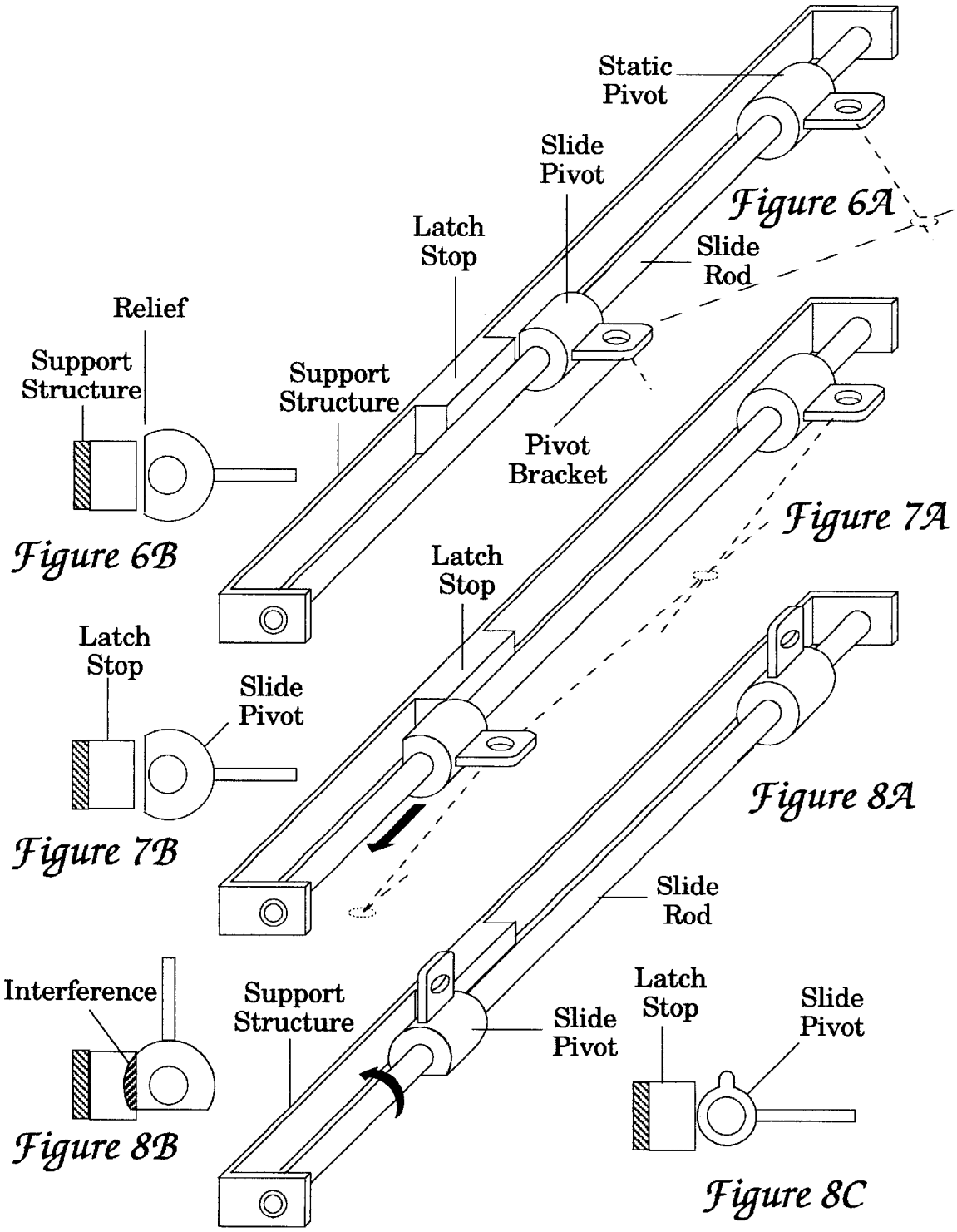
FIG. 6A: Latching scissor link assembly, scissor deployed.
FIG. 6B: Slide pivot orientation, scissor link assembly deployed.
FIG. 7A: Latching scissor mechanism, scissor link assembly retracted.
FIG. 7B: Slide pivot orientation, scissor link assembly retracted.
FIG. 8A: Latching scissor mechanism, scissor link assembly pivoted.
FIG. 8B: Slide pivot orientation, scissor link assembly pivoted.
FIG. 8C: Alternative slide pivot configuration.

FIGS. 9A and 9B illustrate the preferred embodiment of the latching scissor mechanism for an extendable carrying case with the static support bracket 1 rigidly secured to an extendable carrying case. The slide rod 2 and latch stop 3 are rigidly secured to support bracket 1 with the static pivot 4 pivotally secured to slide rod 2 and the slide pivot 5*a* slideably and pivotally secured to slide rod 2. As shown in FIG. 9B the scissor link assembly 6 is fully extended with the slide pivot 5*a* positioned in proximity to the static pivot 4 Because of the relief 7*a* in slide pivot 5 as shown in FIG. 9C the latch stop 3 does not interfere with sliding movement of the slide pivot 5 on rod 2.

Upon retraction of scissor link assembly 6 the slide pivot 5*a* moves axially along rod 2 away from the static pivot 4 clear of static latch stop 3 as shown in FIG. 9B. Folding of the extendable carrying case causes the pivots 4 and 5 to rotate about the slide rod 2 as shown in FIG. 9D without axial displacement of slide pivot 5*a*. However rotation of slide pivot 5*a* rotates relief 7*a* so that static latch stop 3 now interferes with axial motion of slide pivot 5*a* towards static pivot 4, necessary for scissor link assembly 6 to extend. Hence rotation of slide pivot 5 about slide rod 2 locks slide pivot 5*a* against static latch stop 3, latching scissor link assembly 6 in the retracted position. Extension 7*b* of slide pivot 5*b* , shown in FIG. 5E provides an alternative interference means with latch stop 3.

While there have been described what is at present considered to be the preferred embodiment of the latching scissor mechanism, it will be obvious to those skilled in the art that various changes and modifications may be made therein without departing from the invention, and it is the objective therefore in the appended claims to cover all such changes and modifications as fall within the true spirit and scope of the invention.

I claim:

1. A self-latching scissor device comprising the upper and lower modules of a carrying case, a scissor link assembly pivotally secured to slide pivots, said pivots rotatably and slideably secured to slide rods, said rods rigidly secured at both ends to static support brackets rigidly secured to said modules;

whereupon retraction of said modules and thereby said scissor link assembly displaces said slide pivots along said slide rods and rotation of said scissor link assembly relative to said modules latches said slide pivots by static latch stops, precluding said scissor link assembly, and thereby said modules, from extension.

2. A self-latching scissor device according to claim 1 wherein said static latch stops are rigidly secured to said static support brackets.

3. A self-latching scissor device according to claim 1 wherein relief in said slide pivots allows said slide pivots to slide freely past said latch stops without interference, whereupon rotation of said scissor link assembly relative to said modules said latch stops interfere with displacement of said slide pivots.

4. A self-latching scissor device according to claim 1 wherein extensions on said slide pivots allows said slide pivots to slide freely past said latch stops without interference, whereupon rotation of said scissor link assembly relative to said modules said latch stops interfere with displacement of said slide pivots.

* * * * *